US005309695A

United States Patent [19]

Frabetti et al.

[11] Patent Number: 5,309,695

[45] Date of Patent: May 10, 1994

[54] PACKET BANDING DEVICE

[75] Inventors: Fabio Frabetti; Alessandro Minarelli, both of Bologna, Italy

[73] Assignee: G. D Societa' per Azioni, Bologna, Italy

[21] Appl. No.: 957,814

[22] Filed: Oct. 8, 1992

[30] Foreign Application Priority Data

Oct. 21, 1991 [IT] Italy ..... B091A 000385

[51] Int. Cl.[5] ..... B65B 57/12

[52] U.S. Cl. ..... 53/136.1; 53/69; 53/73; 53/136.3; 156/364; 156/568; 271/197

[58] Field of Search ..... 53/68, 69, 73, 136.1, 53/136.3, 136.4; 156/364, 568, 571; 271/6, 12, 94, 197, 276

[56] References Cited

U.S. PATENT DOCUMENTS

| | | | |
|---|---|---|---|
| 3,899,385 | 8/1975 | Brinkmeier | 271/197 X |
| 3,989,577 | 11/1976 | Watson | 156/364 |
| 4,046,613 | 9/1977 | Kucheck et al. | 156/364 X |
| 4,314,869 | 2/1982 | Crankshaw | 156/364 X |
| 4,452,255 | 6/1984 | Brand | 271/197 X |
| 4,526,360 | 7/1985 | Focke | 271/197 X |
| 4,526,645 | 7/1985 | Malthouse et al. | 156/568 X |
| 4,589,943 | 5/1986 | Kimball et al. | 156/568 X |
| 4,647,333 | 3/1987 | Voltmer et al. | 156/364 X |
| 4,687,535 | 8/1987 | Voltmer | 156/568 X |

FOREIGN PATENT DOCUMENTS

| | | | |
|---|---|---|---|
| 0101278 | 2/1984 | European Pat. Off. | 53/136.1 |
| 2181401 | 4/1987 | United Kingdom | 53/136.1 |

*Primary Examiner*—John Sipos
*Assistant Examiner*—Daniel Moon
*Attorney, Agent, or Firm*—Sandler Greenblum & Bernstein

[57] ABSTRACT

A device for applying adhesive bands to packets, whereby an annular conveyor feeds the bands along a path having a first portion extending along a portion of the path along which the packets are supplied, a second portion extending between the output of the first portion and a loading station where the bands are loaded on to the conveyor, and a third portion extending between the loading station and the input of the first portion and past a gumming device; the conveyor being a suction conveyor having at least a first suction chamber wherein a selective vacuum is formed and extending along the first and second portions of the path along which the bands are fed, and a second suction chamber wherein a constant vacuum is maintained and extending along the third portion of the path along which the bands are fed.

9 Claims, 2 Drawing Sheets

PACKET BANDING DEVICE

BACKGROUND OF THE INVENTION

The present invention relates to a packet banding device.

In particular, the present invention relates to a device for applying adhesive bands to parallelepiped packets.

The present invention is especially suitable for use on packing machines, particularly cigarette packing machines, to which the following description refers purely by way of example.

In the tobacco industry, it is necessary at times to apply adhesive bands, usually in the form of inland revenue or advertising strips, to the outside of the packets. This is normally done using devices comprising a feedbox from which the bands are withdrawn one by one and fed successively along a path having at least one portion in common with the path along which the packets are fed. Prior to reaching the common portion of the path, along which the bands are applied to the packets, the bands are fed through a gumming device by which the packet mating surface of the band is coated with adhesive.

Though satisfactory under normal operating conditions of the packing machine, known devices of the aforementioned type present several drawbacks in the event the packing machine is slowed down or arrested. In fact, mainly on account of its size, the gumming device can seldom be set up immediately upstream from the point at which the bands are actually applied to the packets along the common portion of the path, so that, at any given time, unused gummed bands are invariably present between the gumming device and the point of application.

As stoppage of the packing machine is normally accompanied by simultaneous stoppage of the hand feed device, the gummed bands, with the gum already drying, must be extracted, even if not rejected, by means of a relatively complex, time-consuming operation prior to restarting the packing machine.

Moreover, in the event of an emergency requiring stoppage of the gumming device, the inertia of the machine following the stop signal results in the production, downstream from the gumming device, of a certain number of nongummed bands posing the same difficulties as described above.

SUMMARY OF THE INVENTION

It is an object of the present invention to provide an adhesive band feed device designed to overcome the aforementioned drawbacks.

According to the present invention, there is provided a device for applying adhesive bands to substantially parallelepiped packets, said device comprising a first conveyor for feeding said packets at a predetermined frequency and speed along a first path; a second conveyor for feeding said bands, at said frequency and speed, along a given portion of said first path; a station wherein the bands are loaded on to said second conveyor; a device for feeding the bands, at said frequency, to said loading station; and a band gumming device; characterized by the fact that the second conveyor defines a second annular path comprising a first portion extending along said given portion of the first path and having an input end and an output end, and a second and third portion arranged in series and connecting said output end to said input end; the second conveyor providing for feeding the bands along the second path at said speed and frequency; the loading station being located between the second and third portions of the second path; the gumming device being located along the third portion of the second path; the second conveyor being a suction conveyor and comprising at least a first and second suction chamber extending respectively along the first and second and along the third portion of the second path; and suction means being provided for maintaining a constant vacuum in the second chamber and P selective vacuum in the first chamber.

Said first and second chambers of the device as described above are preferably arranged in series along the second path and at a given distance from each other, and define a gap extending along the first portion of the second path; and the second conveyor comprises a third suction chamber located at said gap, connected to said suction means, and in which a vacuum is formed selectively together with said first chamber.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
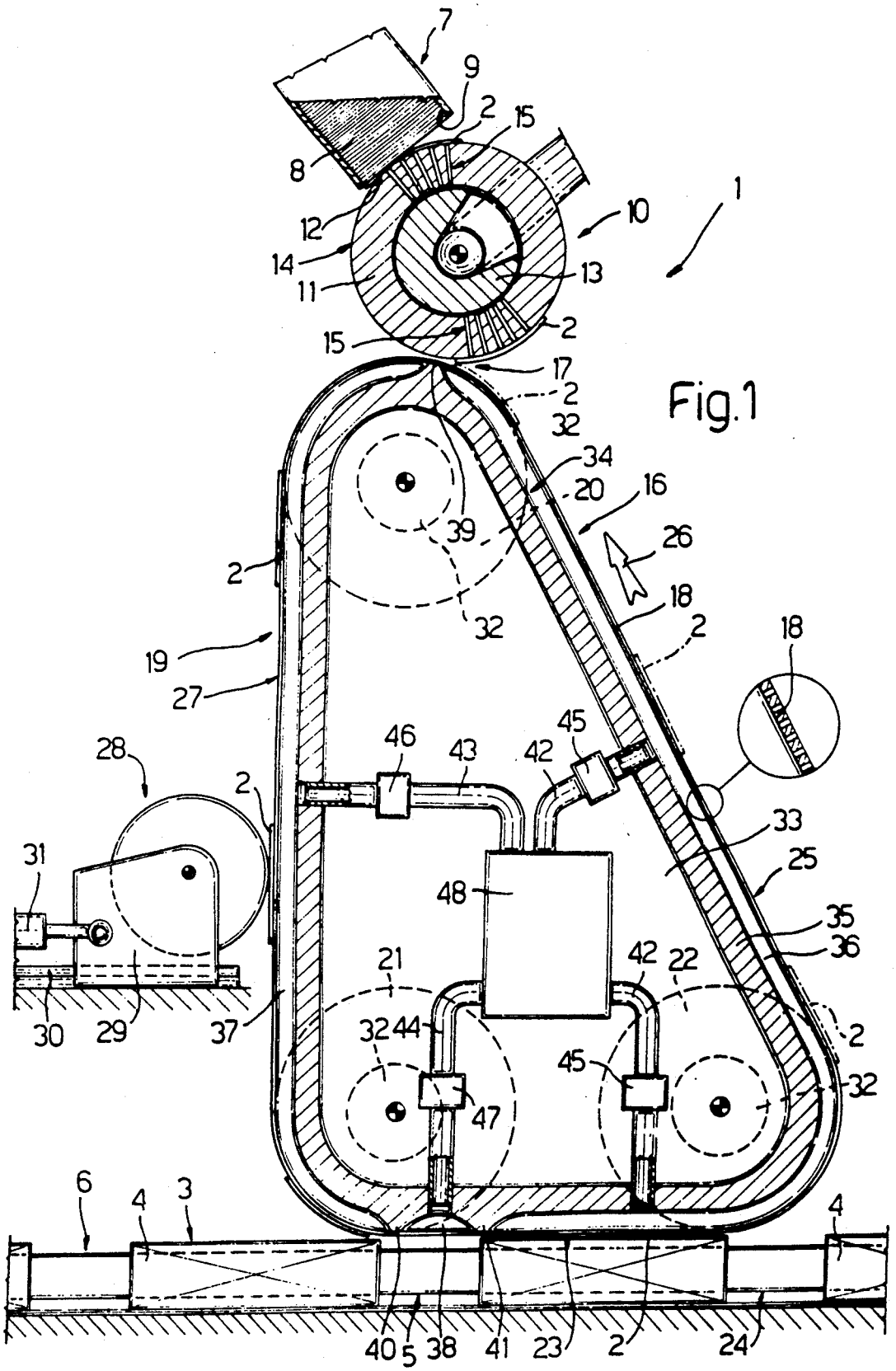
FIG. 1 shows a schematic cross section of a preferred embodiment of the device according to the present invention.

Number 1 in FIG. 1 indicates a device for applying flexible adhesive bands 2 to the lateral surface 3 of packets of cigarettes 4 substantially in the form of a rectangular parallelepipedon and fed by a conveyor 5, at a substantially constant given frequency and speed, along a substantially straight path 6 parallel to surface 3 and extending along a portion of a cigarette packing machine (not shown).

Device 1 comprises a container or store 7 for a stack 8 of bands 2 and having an opening 9 at the bottom through which bands 2 are withdrawn one by one by a known extracting device 10 comprising a powered suction roller 11 tangent to the bottom surface 12 of container 7 and mounted for rotation on a cylindrical support 13 perpendicular to the FIG. 1 plane and parallel to surface 12.

Roller 11 presents a cylindrical outer surface 14, and two diametrically-opposed suction sectors 15 separated by a distance, measured along the edge of roller 11, equal to the spacing of packets 4 fed along conveyor 5. As roller 11 turns about its axis, clockwise in FIG. 1 and at a surface speed equal to the traveling speed of conveyor 5, sectors 15 withdraw bands 2 from container 7 at a given constant frequency equal to that at which packets 4 are fed along conveyor 5.

Device 1 also comprises a second conveyor 16 located between roller 11 and conveyor 5 and tangent to roller 11 at a station 17 at which bands 2 are loaded on to conveyor 16. Conveyor 16 comprises a permeable annular belt 18 extending along a substantially rounded triangular path 19, and looped about three pulleys 20, 21 and 22 rotating anticlockwise (in FIG. 1) about respective parallel axes parallel to the axis of cylindrical support 13. Pulley 20 is tangent to roller 11 at station 17, while pulleys 21 and 22 respectively define the input and output ends of a first straight portion 23 of path 19 parallel to and substantially coincident with a corresponding portion 24 of path 6.

In addition to portion 23, path 19 also comprises a second straight portion 25 extending between pulleys 22 and 20 in the traveling direction of belt 18 indicated by arrow 26; and a third straight portion 27 extending between pulleys 20 and 21 through a gumming station 28 comprising a known gumming device 29. At station 28, the outer surface of each band 2 on belt 18 is at least partially coated in known manner with a layer of gum by gumming device 29, which is mounted on a runner 30 and moved, by an actuator 31, to and from an operating position wherein it substantially contacts the portion of belt 18 extending along portion 27. Pulleys 20, 21 and 22 are supported on respective shafts 32 in turn supported on the end wall 33 of a casing 34, the lateral wall 35 of which, perpendicular to the FIG. 1 plane and parallel to shafts 32, presents, when viewed in cross section parallel to the FIG. 1 plane, substantially the same triangular shape as path 19.

On the outer surface of wall 35, there are formed three grooves located inwards of belt 18 and defining, with the same, respective chambers 36, 37 and 38; chamber 36 extending along an output end portion of portion 23 of path 19, around pulley 22 and along the whole of portion 25 up to loading station 17; chamber 37 being separated from chamber 36 by a partition wall 39 at loading station 17, and extending along the whole of portion 27 of path 19 and around pulleys 20 and 21; and chamber 38 extending along a gap between chambers 36 and 37 in the initial portion of portion 23 of path 19. Chamber 38 is separated, on one side, from the end of chamber 37 by a partition wall 40, and, on the other, from the start of chamber 36 by a partition wall 41.

Chambers 36, 37 and 38 are connected to a suction source 48 via respective conduits 42, 43 and 44 fitted with respective on-off valves 45, 46 and 47. More specifically, chamber 36 presents two conduits 42 on either side of pulley 22 and each fitted with a respective valve 45.

In actual use, under normal operating conditions of conveyor 5 wherein packets 4 are fed successively to portion 24 of path 6 at the set frequency and speed, source 48 is operative, valve 46 is open for maintaining a constant vacuum inside chamber 37, and valves 45 and 47 are closed for maintaining chambers 36 and 38 at the atmospheric pressure outside belt 18. At the same time, belt 18 is fed in the direction of arrow 26 at the same speed as conveyor 5, and roller 11 and suction sectors 15 are activated for feeding bands 2 to loading station 17 at the same frequency and speed as packets 4 along path 6 and in time with packets 4.

As the leading end of band 2 on roller 11 contacts belt 18 immediately downstream from partition wall 39 in the direction of arrow 26, the suction through sector 15 is cut off, and band 2 is withdrawn by belt 18 and fed around pulley 20, along portion 27 of path 19, and around pulley 21.

As the leading end of band 2 reaches partition wall 40, band 2 engages respective packet 4 and, by virtue of being gummed by device 29 in gumming station 28, is applied as required to surface 3 of packet 4. As chambers 38 and 36 are idle, nothing prevents band 2 from being applied perfectly to packet 4 and detached from belt 18.

In the event of stoppage in the supply of packets 4 along path 6, a machine stop signal, or a signal emitted by a sensor (not shown) for detecting the absence of packets 4 on conveyor 5, disables suction sectors 15, thus preventing bands 2 from being withdrawn from container 7; operates actuator 31 for detaching gumming device 29 from belt 18 and so preventing bands 2 on conveyor 16 from being gummed; and opens valves 45 and 47 for creating a vacuum in chambers 36 and 38.

Consequently, each band 2, on reaching the output end of portion 27 of path 19 in the direction of arrow 26, and on traveling around pulley 21 to partition wall 40, continues along portion 23 of path 19, along which it is held on belt 18 by the vacuum in chambers 38 and 36, and is circulated along path 19 until packets 4 are again supplied along path 6.

As supply of packets 4 is restored, gumming device 29 is restored to the operating position in relation to belt 18, and valve 47 is closed, thus enabling the recirculated bands 2, on reaching portion 23 of path 19, to be detached from belt 18, by virtue of the absence of a vacuum in chamber 38, and applied perfectly to packet 4 before reaching chamber 36 in which the vacuum is still operative. Valve 45, in fact, is not closed and suction sectors 15 not reactivated until some time later, when a further sensor (not shown) determines that bands 2 recirculated along portion 25 of path 19 have all been used up.

Figure 2:
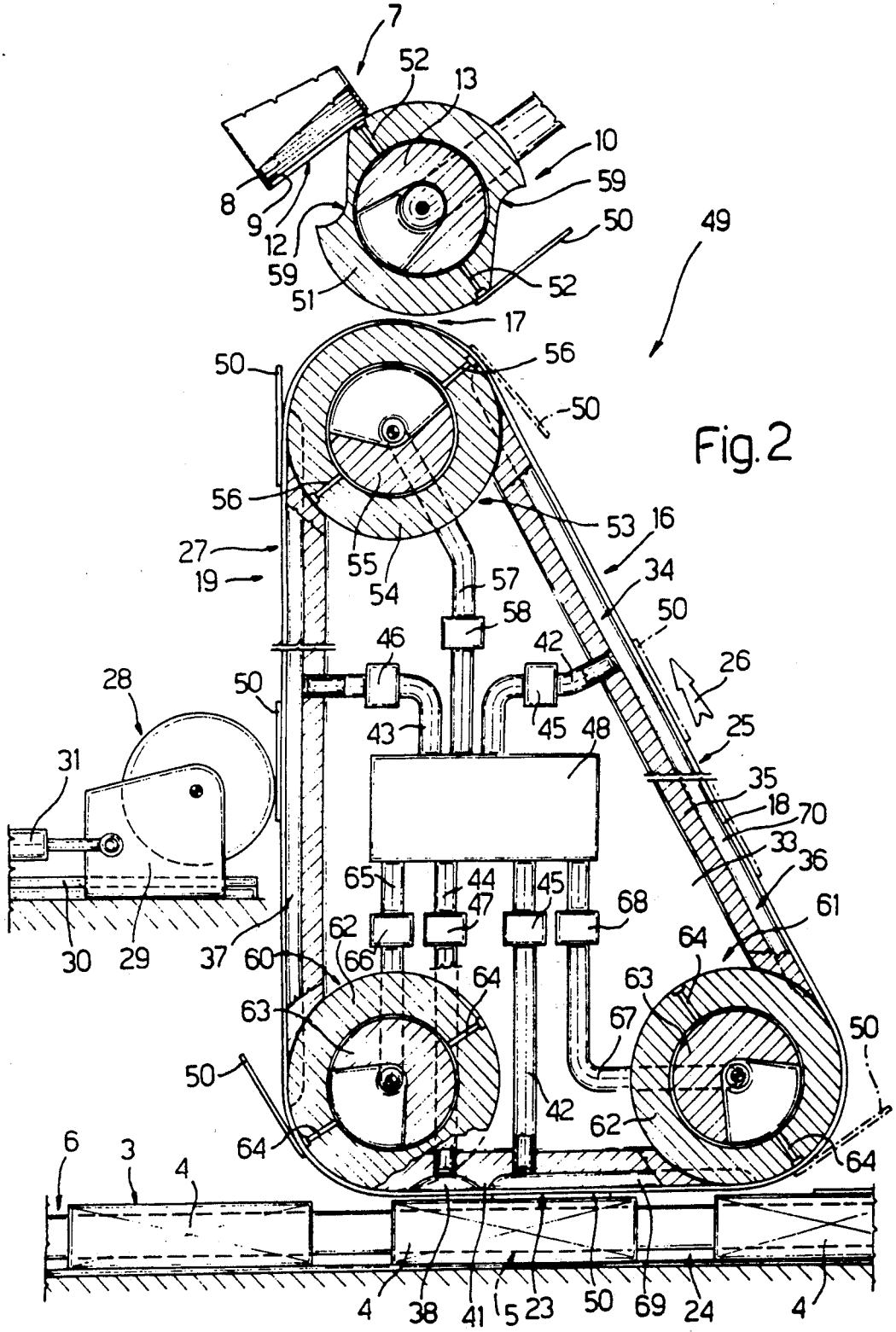
FIG. 2 shows a schematic cross section of a variation of the FIG. 1 device.

The FIG. 2 variation relates to a device 49 substantially similar to device 1 and the component parts of which are indicated where possible using the same numbering system.

Unlike bands 2, which are flexible, device 49 provides for applying rigid bands 50 on to packets 4.

Consequently, in place of roller 11, extracting device 10 of device 49 comprises a roller 51 having two diametrically-opposed suction conduits 52, each designed to engage the leading end, in the clockwise rotation direction of roller 51 in FIG. 2, of a respective band 50, withdraw it from container 7, and feed it, leading end first, to loading station 17.

When so transferred, band 50 adheres solely by the leading end to belt 18, on which it is only supported fully after completing the curved portion of path 19 extending through loading station 17. For this purpose, chambers 36 and 37 do not extend over the curved portion of path 19, along which bands 50 are fed by a transfer device 53 substituting pulley 20 of device 1.

Transfer device 53 is similar to extracting device 10, and comprises a roller 54 mounted for rotation on a cylindrical support 55 and having two diametrically-opposed suction conduits 56, each communicating with suction source 48 via a conduit 57 with an on-off valve 58, and each reaching loading station 17 in time with a respective conduit 52 for engaging the leading end of a respective band 50.

As it travels over the curved portion of belt 18 tangent to roller 54, the rear portion of band 50 sweeps through the space immediately outwards of said curved portion, and would interfere with roller 51 if provision were not made on the outer surface of roller 51 for two cavities 59, each located immediately downstream from a respective suction conduit 52.

In place of pulleys 21 and 22 of device 1, device 49 presents two transfer devices 60 and 61 similar to transfer device 53 and each comprising a roller 62 similar to roller 54 and mounted for rotation on a respective cylindrical support 63. Each roller 62 presents two diametrically-opposed suction conduits 64 communicating with suction source 48. More specifically, conduits 64 of transfer device 60 communicate with suction source 48 via a conduit 65 with an on-off valve 66, while conduits 64 of transfer device 61 communicate with suction source 48 via a conduit 67 with an on-off valve 68.

Unlike device 1, chamber 37 of device 49 terminates at the output end (in the direction of arrow 26) of portion 27 of path 19, and at the start of the curved portion of belt 18 tangent to roller 62 of transfer device 60; and conduits 64 of transfer device 60 are so timed as to successively engage the leading ends of rigid bands 50 and feed them along said curved portion to portion 23 of path 19, with no interference whatsoever between bands 50 and path 6 of packets 4 along conveyor 5.

Moreover, unlike chamber 36 of device 1, which is continuous, that of device 49 is divided into two subchambers 69 and 70 connected to respective conduits 42 and located respectively up- and downstream (in the direction of arrow 26) from the curved portion of belt 18 tangent to roller 62 of transfer device 61. Conduits 64 of transfer device 61 are so timed as to successively engage the trailing ends of rigid bands 50 and feed them along said curved portion to portion 25 of path 19, with no interference whatsoever between bands 50 and path 6 of packets 4 along conveyor 5.

Device 49 operates in exactly the same way as device 1 and therefore requires no further explanation, except for the fact that valves 58 and 66 are open simultaneously with valve 46, and valve 68 simultaneously with valves 45.

We claim:

1. A device for applying adhesive bands to substantially parallelepiped packets, said device comprising a first conveyor for feeding said packets at a predetermined frequency and speed along a first path; a second conveyor for feeding said bands, at said frequency and speed, along a given portion of said first path; a station wherein the bands are loaded onto said second conveyor; a device for feeding the bands, at said frequency, to said loading station; and a band gumming device; said second conveyor defining a second path, said second path being annular and comprising a first portion extending along said given portion of the first path and having an input end and an output end, and a second portion and third portion arranged in series and connecting said output end to said input end; the second conveyor providing for feeding the bands along the second path at said speed and frequency; the loading station being located between the second and third portions of the second path; the gumming device being located along the third portion of the second path; the second conveyor being a suction conveyor and comprising at least a first suction chamber extending along the first and second portions of the second path through said output end and up to said loading station; and a second suction chamber extending along the third portion of the second path from the loading station to said input end; and suction means being provided for maintaining a constant vacuum in the second chamber for feeding bands from the loading station to the input end and said suction means providing a selective vacuum in the first chamber for selectively feeding bands through the output end and up to said loading station, whereby bands may be recirculated through said loading station.

2. A device as claimed in claim 1, wherein said first and second chambers are located a given distance from each other along the second path, and define a gap extending along the first portion of said second path.

3. A device as claimed in claim 2, wherein the second conveyor comprises a third suction chamber located at said gap, connected to said suction means, whereby a vacuum is formed selectively in said third suction chamber and said first chamber.

4. A device as claimed in claim 3, wherein said second path is a substantially triangular path comprising three sides and three curved connecting portions between the sides; said first, second and third portions extending along respective sides of the second path; and said first chamber extending along the first and second portions of said second path.

5. A device as claimed in claim 4, wherein said device applies rigid adhesive bands to substantially parallelepiped packets; said first chamber comprising a first and second subchamber extending respectively along the first and second portions of said second path and separated by a given distance so as to define a further gap extending along one of said curved connecting portions; first transfer means being provided for holding said bands on said second conveyor at said further gap.

6. A device as claimed in claim 5, wherein said first transfer means comprises vacuum means traveling along said further gap at said predetermined frequency and speed and in time with said bands; said vacuum means engaging respective end portions of said bands.

7. A device as claimed in claim 5, wherein said second chamber extends along the third portion of the second path, and wherein another gap extends along one of said curved connecting portions of said second path; second transfer means being provided for holding said bands on the second conveyor at said another gap.

8. A device as claimed in claim 7, wherein vacuum means of said second transfer means engage respective leading end portions of the bands in the traveling direction of the bands along said second path.

9. A device as claimed in claim 7, wherein vacuum means of said first transfer means engage respective trailing end portions of the bands in the traveling direction of the bands along said second path.

* * * * *